US010640909B2

(12) United States Patent
McCloy

(10) Patent No.: US 10,640,909 B2
(45) Date of Patent: May 5, 2020

(54) WASHING MACHINE FILL RESERVOIR

(71) Applicant: John McCloy, Baldwin, NY (US)

(72) Inventor: John McCloy, Baldwin, NY (US)

( * ) Notice: Subject to any disclaimer, the term of this patent is extended or adjusted under 35 U.S.C. 154(b) by 384 days.

(21) Appl. No.: 15/386,650

(22) Filed: Dec. 21, 2016

(65) Prior Publication Data

US 2017/0191207 A1 Jul. 6, 2017

Related U.S. Application Data

(60) Provisional application No. 62/274,516, filed on Jan. 4, 2016.

(51) Int. Cl.

| | |
|---|---|
| ***D06F 39/08*** | (2006.01) |
| ***D06F 39/04*** | (2006.01) |
| ***D06F 39/02*** | (2006.01) |

(52) U.S. Cl.

CPC ..... *D06F 39/088* (2013.01); *D06F 39/022* (2013.01); *D06F 39/045* (2013.01); *D06F 39/083* (2013.01); *D06F 39/087* (2013.01)

(58) Field of Classification Search

CPC .... D06F 39/088; D06F 39/087; D06F 39/083; D06F 39/022; D06F 39/045; D06F 39/04; D06F 39/006; D06F 39/12; D06F 39/02

See application file for complete search history.

(56) References Cited

U.S. PATENT DOCUMENTS

| | | | | |
|---|---|---|---|---|
| 4,188,807 | A * | 2/1980 | Graf | D06F 35/00 68/17 R |
| 4,489,574 | A * | 12/1984 | Spendel | C11D 3/386 68/16 |
| 7,963,130 | B2 * | 6/2011 | Kim | D06F 39/04 68/12.15 |
| 2004/0154094 | A1 * | 8/2004 | Ostrowski | A61H 33/0087 4/541.1 |
| 2004/0255391 | A1 * | 12/2004 | Kim | D06F 35/006 8/149.3 |
| 2005/0183208 | A1 * | 8/2005 | Scheper | D06F 25/00 8/142 |
| 2007/0130698 | A1 * | 6/2007 | Kim | D06F 35/006 8/158 |
| 2008/0000098 | A1 * | 1/2008 | Choi | D06F 58/04 34/114 |
| 2008/0011022 | A1 * | 1/2008 | Ahn | D06F 39/008 68/5 R |
| 2008/0168805 | A1 * | 7/2008 | Kim | D06F 39/008 68/5 C |

(Continued)

*Primary Examiner* — Benjamin L Osterhout

(57) ABSTRACT

A washing machine fill reservoir includes a basin large enough to replenish a volume of water to adequately fill a washing machine drum of a washing machine. Inlet valves allow for introduction of hot and cold water and additives such as-soap, fabric softener, chlorine bleach and emulsifiers. A large orifice valve positioned between the washing machine fill reservoir and the washer drum enables prompt introduction of the fluid maintained in the washing machine fill reservoir to be conveyed into the washer drum. Fluid level in the washing machine fill reservoir may be either fixed volume or adjustable via an internal or external sensing device. The washing machine fill reservoir offers a significantly reduced operating duration of the washing machine, without diminishing the quality of the laundering process.

6 Claims, 1 Drawing Sheet

(56) References Cited

U.S. PATENT DOCUMENTS

| | | | | |
|---|---|---|---|---|
| 2009/0107188 | A1* | 4/2009 | Park | D06F 39/008 68/5 R |
| 2009/0151400 | A1* | 6/2009 | Park | D06F 39/008 68/5 C |
| 2009/0293557 | A1* | 12/2009 | Ahn | D06F 39/008 68/5 R |
| 2010/0058544 | A1* | 3/2010 | Park | D06F 33/02 8/149.3 |
| 2010/0139334 | A1* | 6/2010 | Kim | D06F 39/008 68/5 C |
| 2010/0154250 | A1* | 6/2010 | Bae | D06F 58/203 34/549 |
| 2010/0288743 | A1* | 11/2010 | Kim | D06F 39/008 219/201 |
| 2012/0060302 | A1* | 3/2012 | Hanau | D06F 58/203 8/137 |
| 2014/0060121 | A1* | 3/2014 | Burger | D06F 39/02 68/17 R |

* cited by examiner

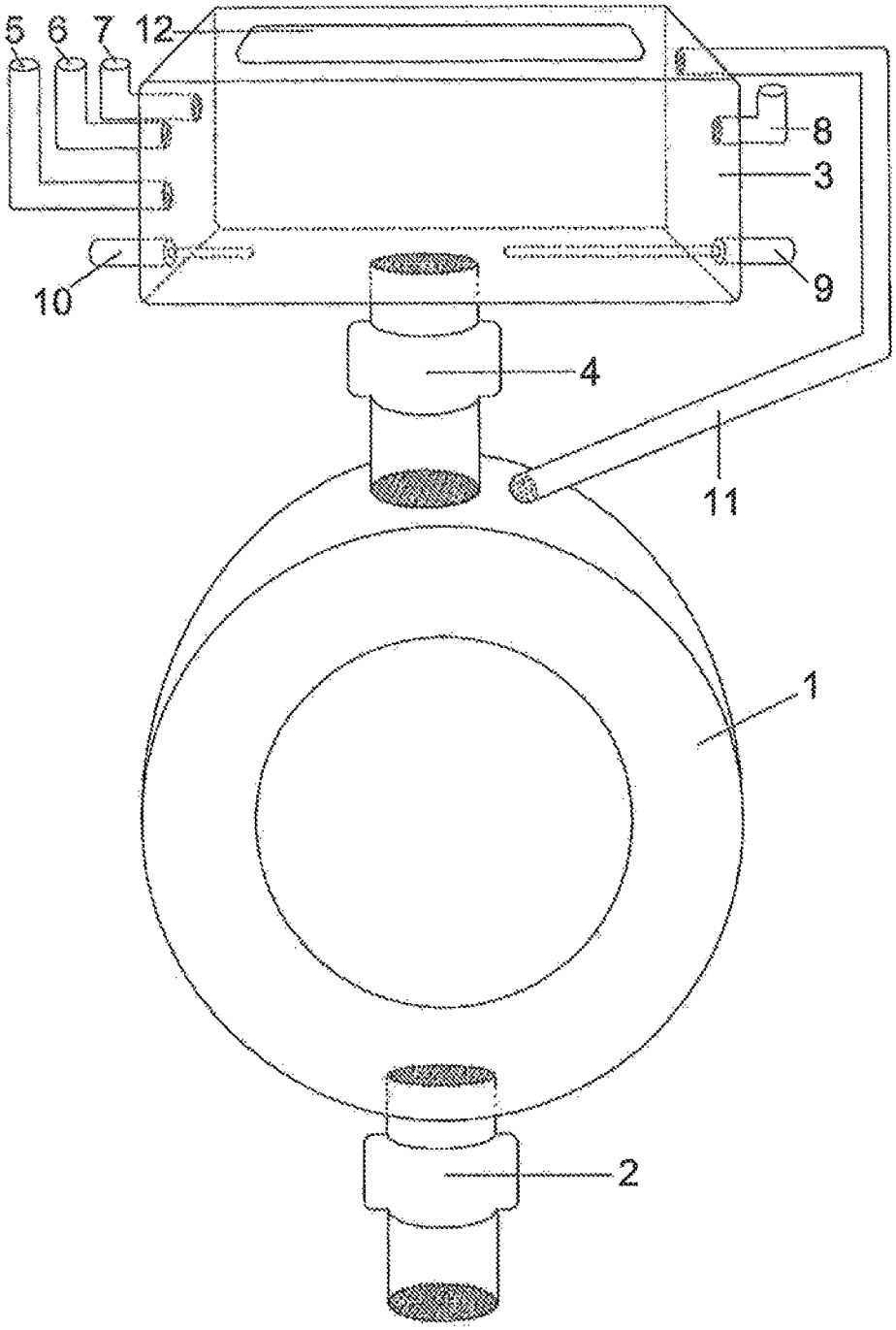
5
6
7
12
8
3
10
9
4
11
1
2

WASHING MACHINE FILL RESERVOIR

BACKGROUND OF THE INVENTION

This invention relates to utilization of a water holding chamber distinct and separate from the main wash drum which encompasses the wash cylinder into which the laundry load is placed.

The chamber is a vessel into which passes the water introduced into a laundry washing machine, prior to that water being conveyed into the wash drum.

The chamber allows for the accumulation of water until such time as the washing machine calls for the replenishment of water, at which time the entire volume of accumulated liquid is rapidly conveyed from the water holding chamber into the wash drum through means of a large diameter orifice.

It further allows for the chamber to be conduit where additives can be introduced by means of port(s) integrated into the body of the vessel.

Furthermore, temperature of the water can be maintained or raised while contained in the chamber via an integrated heating element and thermostat controller.

In providing for the manufacture of washing machines, it has heretofore been the practice to introduce water directly or indirectly through orifices, hoses, or similar conveyance methods which are restricted by pressure and/or diameter limitations.

Typically, the washing machine sits idle during the time it takes for the desired water level to be achieved. Integration of this device drastically reduces the idle time between wash cycle segments, resulting in shorter complete wash cycle duration and greater washing machine efficiency, without diminishing the quality of the laundering process.

SUMMARY OF THE INVENTION

The subject of the invention is a chamber, known as the Washing Machine Fill Reservoir, which holds water and optionally other liquids such as soap, fabric softening agents or other chemical compounds, while the laundry is being laundered inside the washing machine drum.

The chamber would be sufficiently sized to accommodate a volume of liquid equal to the maximum amount necessary for a wash cycle segment.

A complete wash cycle consists of multiple fill, agitate, drain and repeat cycle segments, typically ranging from three to seven wash cycle segments to complete the laundering process, yielding an overall operational time which can be extensive.

The heretofore laundering process typically includes significant idle time while the washing machine refills with liquids, which is limited by delivery constraints associated with standard pressurized water line conveyance.

By utilizing the Washing Machine Fill Reservoir, the water along with any desired additives can be introduced immediately at the beginning of each cycle segment after the first, thus eliminating the associated idle time.

Since the time it takes to refill the Washing Machine Fill Reservoir takes place simultaneously while the laundry is being subjected to agitation within the wash drum, the complete wash processing time is significantly reduced.

BRIEF DESCRIPTION OF THE DRAWING

FIG. 1 is a perspective view illustrating the invention along with the main functional components of a washing machine, through which liquids travel during the laundering process.

FIG. 1 further identifies additional valve orifices and optional parts, in relationship to the other components.

This design provides a separate and distinct Washing Machine Fill Reservoir as a non-contiguous component of the wash drum.

Previous attempts to provide improvements include U.S. Pat. No. 7,963,130 B2 which references a design which does not incorporate a liquid holding chamber separate and apart from the washer drum. In that example, liquid is allowed to freely flow between the water-storing tub and the main wash drum. Since no separate reservoir is present, the time saving design aspect of having a fully filled chamber of liquid immediately available at the onset of each wash cycle segment is not available in that design.

This submitted design allows for complete separation of liquid volumes until called for at the appropriate cycle segment designation.

DETAILED DESCRIPTION OF THE INVENTION

This invention speeds up the process of laundering items in a washing machine by pre-positioning the appropriate amount of liquid necessary to convey into the washing machine wash drum.

A washing machine requires a specific volume of liquid to be introduced into the wash drum (1) at the beginning of each cycle segment. Heretofore, that liquid has been introduced directly into the wash drum.

At the conclusion of each cycle segment, the existing water inside the wash drum drains through an outlet drain valve (2) which has a large aperture, which causes the draining process to occur quickly, but subsequent refilling the wash drum, heretofore has been a time consuming process since the water inlet pipes, hoses and valves are relatively restrictive in their capacity to convey water quickly.

By positioning the Washing Machine Fill Reservoir (3) above the wash drum and closing an additional in-line large-aperture drain valve (4), the Washing Machine Fill Reservoir can be filled with water through cold and hot water inlet valves (5) & (6) while the laundry load is simultaneously being laundered during each wash cycle segment.

At the conclusion of each wash cycle segment, when the drain valve (2) opens it allows the spent liquid to be discharged.

Subsequent to drain valve (2) closing, the Washing Machine Fill Reservoir drain valve (4) is opened, allowing for immediate and rapid water refill of the wash drum.

Soap, fabric softeners and/or additional chemical compounds can be introduced into the Washing Machine Fill Reservoir as desired through the additional port (7) or through multiple ports if more are necessary.

An appropriate amount of water introduced into the Washing Machine Fill Reservoir could be adjusted by a sensor device such as a pressure detector or a water level float/trip mechanism attached to an orifice (8).

If warranted, an optional heating element (9) and associated temperature sensor (10) can be incorporated into the Washing Machine Fill Reservoir to maintain or boost the water temperature.

A vent tube (11) connecting the upper portion of the Washing Machine Fill Reservoir to the upper portion of the outer wash drum allows for pressure equalization facilitating rapid water transfer into the wash drum when drain valve (2) is opened.

The Washing Machine Fill Reservoir design would typically include a removable section (12) to allow for internal access which would aid in replacement of expendable component parts and for occasional internal cleaning.

What is claimed is:

1. A fill reservoir for a washing machine comprising:

(a) a water liquid holding chamber, separate and distinct from that of the a washing machine drum;

(b) hot and cold water inlets incorporated into the liquid holding chamber, said liquid holding chamber configured to fill and retain a maximum volume of liquid required for each individual wash cycle segment, while other aspects of a wash cycle proceed;

(c) a heating element and corresponding thermostat monitor which provides an ability to maintain and/or boost the temperature of liquid prior to the liquid being introduced into the washing machine drum;

(d) a port or multiple ports for introducing liquid soaps, fabric softeners or other chemical compounds which enhance the laundering process;

(e) a conduit through which liquid can travel from the liquid holding chamber to the washing machine drum;

(f) a valve which restricts the travel of liquid through the conduit until such time as an introduction of such liquid is called for;

(g) a vent tube which connects an upper portion of the liquid holding chamber to an upper portion of the washing machine drum, which allows for equalization of air pressure during a process of liquid introduction into the washing machine drum; and (h) a liquid pressure detector or liquid level indicator which provides an ability to determine a proper volume of liquid to be introduced into the liquid holding chamber, wherein said water liquid holding chamber includes a removable cover to avow internal access for cleaning purposes and to facilitate replacement of expendable component parts.

2. A fill reservoir for a washing machine comprising:

a liquid holding chamber, separate and distinct from that of a washing machine drum, the liquid holding chamber configured to fill and retain a volume of liquid required by the washing machine drum that is equal to a maximum amount necessary for each individual wash cycle segment, while other aspects of a wash cycle proceed;

a conduit through which liquid can travel from the liquid holding chamber to the washing machine drum; and a valve which restricts the travel of liquid through the conduit until such time as the introduction of such liquid is called for;

a heating element and corresponding thermostat monitor that provides an ability to maintain and/or boost the temperature of liquid prior to the liquid being introduced into the washing machine drum; and a port or multiple ports for introducing liquid soaps, fabric softeners or other chemical compounds which enhance the laundering process.

3. The fill reservoir for a washing machine according to claim 2, further comprising:

hot and cold water inlets incorporated into the liquid holding chamber.

4. The fill reservoir for a washing machine according to claim 2, further comprising:

a vent tube which connects an upper portion of the liquid holding chamber to an upper portion of the washing machine drum, the vent tube allowing for equalization of air pressure during a process of liquid introduction into the washing machine drum.

5. The fill reservoir for a washing machine according to claim 2, further comprising:

a liquid pressure detector or liquid level indicator which provides an ability to determine a proper volume of liquid to be introduced into the liquid holding chamber.

6. The fill reservoir for a washing machine according to claim 2, wherein:

said liquid holding chamber includes a removable cover to allow internal access for cleaning purposes and to facilitate replacement of expendable component parts.

* * * * *